US006976832B1

(12) United States Patent
Wheeler et al.

(10) Patent No.: US 6,976,832 B1
(45) Date of Patent: Dec. 20, 2005

(54) FLUID ROTARY MACHINE

(75) Inventors: Daryl Wheeler, Gooseberry Hill (AU); Lui Lau, Willetton (AU); Ben Dyktynski, Bayswater (AU)

(73) Assignee: Merlin Corporation Pty. Ltd., Highgate (AU)

( * ) Notice: Subject to any disclaimer, the term of this patent is extended or adjusted under 35 U.S.C. 154(b) by 0 days.

(21) Appl. No.: 09/979,706

(22) PCT Filed: May 30, 2000 (Under 37 CFR 1.47)

(86) PCT No.: PCT/AU00/00624

§ 371 (c)(1), (2), (4) Date: Jul. 24, 2002

(87) PCT Pub. No.: WO00/73627

PCT Pub. Date: Dec. 7, 2000

(30) Foreign Application Priority Data

May 31, 1999 (AU) ..... PQ0674
Nov. 15, 1999 (AU) ..... PQ4057

(51) Int. Cl.[7] ..... F04C 18/00
(52) U.S. Cl. ..... 418/176; 418/172; 418/246; 418/268
(58) Field of Search ..... 418/172, 176, 418/246, 266, 268

(56) References Cited

U.S. PATENT DOCUMENTS 39,829 A * 9/1863 Platt ..... 418/176
741,476 A * 10/1903 Flatau ..... 418/266
967,396 A * 8/1910 Lecaime ..... 418/176
1,253,460 A * 1/1918 Bodge ..... 418/176
1,886,206 A * 11/1932 Mandler ..... 418/176
2,391,360 A 12/1945 Stephens
4,772,185 A * 9/1988 Hertell ..... 418/3

FOREIGN PATENT DOCUMENTS

| | | |
|---|---|---|
| CH | 463429 | 9/1968 |
| FR | 981475 | 5/1951 |
| FR | 995321 | 11/1951 |
| FR | 2285531 | 4/1976 |
| GB | 569795 | 6/1945 |
| GB | 628239 | 8/1949 |
| GB | 780466 | 7/1957 |
| GB | 888942 | 2/1962 |

* cited by examiner

*Primary Examiner*—Theresa Trieu
(74) *Attorney, Agent, or Firm*—Clark and Elbing LLP; Paul T. Clark

(57) ABSTRACT

A fluid rotary machine (10) includes an inner housing (12) provided with a manifold (68) for directing working fluid through the machine (10) and an outer housing (14) coupled to the inner housing (12) so that the outer housing (14) can rotate relative to the inner housing (12). A plurality of swinging gates (16) are supported along one longitudinal edge in corresponding sockets (38) formed along the inner circumferential surface (32) of outer housing (14). A plurality of elongated lobes (30) are supported on and evenly spaced about the inner housing (12). There is one intake port (24) and one exhaust port (26) between adjacent lobes (30). The gates (16) are biased so as to ordinarily seal against the inner housing (12). High pressure fluid enters through the inlet port (24) to a region between a lobe (30) and gate (16) causing the outer housing (14) to rotate. Eventually the gate (16) wipes across an exhaust port (26) venting the high pressure fluid through the exhaust port. The gate (16) is then lifted from the surface of the inner housing (12) by contact with the next lobe (30).

18 Claims, 10 Drawing Sheets

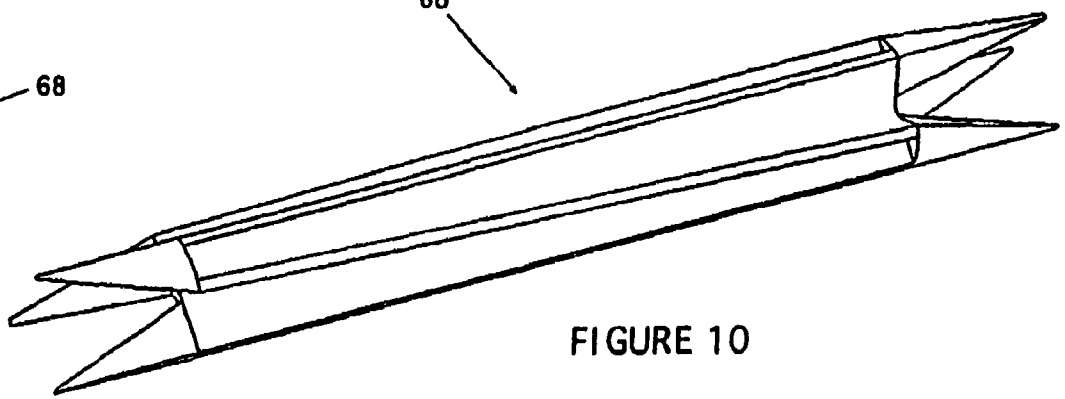
FIGURE 10
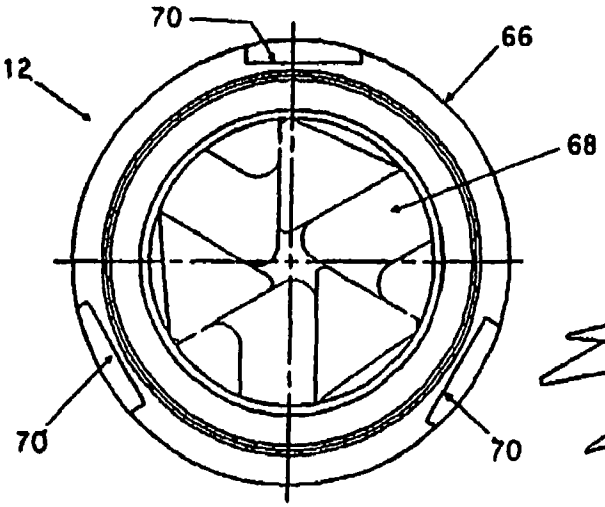
FIGURE 8
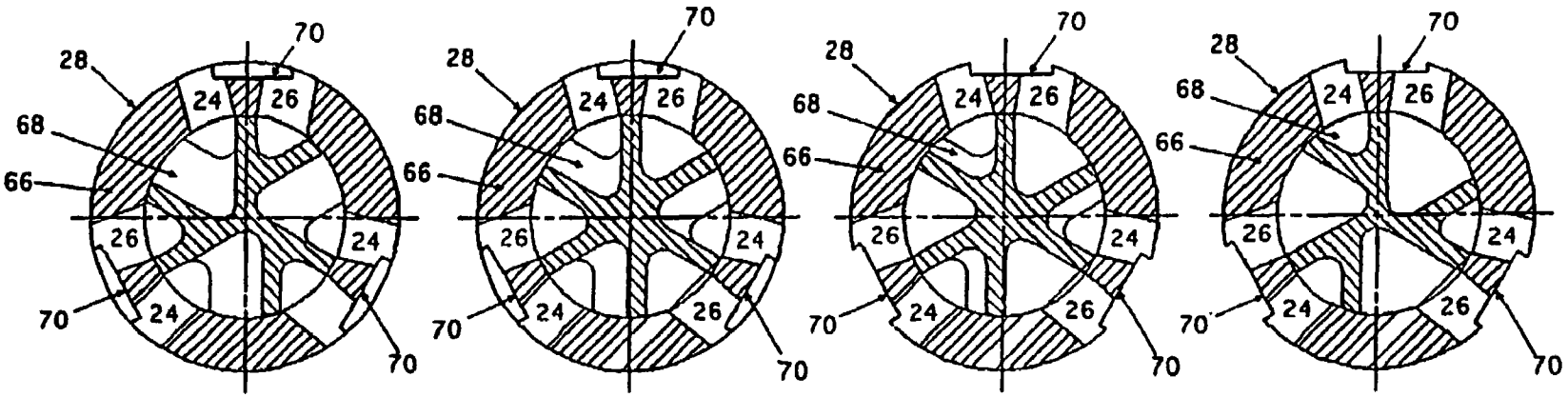
FIGURE 12
FIGURE 13
FIGURE 14
FIGURE 15

FLUID ROTARY MACHINE

FIELD OF THE INVENTION

The present invention relates to a fluid rotary machine.

BACKGROUND OF THE INVENTION

Throughout this specification and claims the term "fluid rotary machine" is intended to include both rotary motors and rotary pumps.

Fluid rotary machines have been known and used in various industries ever since the industrial revolution. In general terms, to operate as a motor, a high pressure fluid is feed through the machine and the pressure of the fluid used to impart motion to mechanical components to generate a mechanical kinetic energy that is then used to power or drive some other machine. When used as a pump, mechanical power is imparted to mechanical components of the pump which displace or force fluid through various ports to create a fluid flow and thus a pumping action.

The Applicant has been particularly innovative in the design and manufacture of fluid rotary machines particularly, although not exclusively, for use as motors in oil and gas drilling. One example of such is the hydraulic motor is described in International Application No PCT/AU97/00682. A substantial benefit of the motor described in the aforementioned application is that in comparison with other known motors, it has a substantially higher power density or power to weight ratio. This enables the motor to be of a significantly shorter length for the same power output in comparison to a convention motor. This allows greater precision in directional control of the drill and the ability to turn at substantially smaller radii than can be achieved with the prior art.

Notwithstanding the substantial benefits of the motor described in the abovementioned international application, the Applicant continues to conduct research and development for the purposes of producing a smaller, shorter and simpler fluid rotary machine with higher power density than is currently available. This research and development has lead to the invention described herein.

SUMMARY OF THE INVENTION

According to the present invention there is provided a fluid rotary machine comprising at least:

a fluid rotary machine comprising at least:

an inner housing provided with a manifold for directing working fluid through said machine;

an outer housing rotatably coupled with the inner housing to facilitate rotational motion of the outer housing relative to the inner housing, with at least one working chamber through which the working fluid can flow being defined between the inner housing and outer housing, said inner housing disposed coaxially within said outer housing; and, a plurality of gates supported on the outer housing, each gate being able to swing along its respective longitudinal axis between a sealing position in which the gate forms a seal on the outer circumferential surface of the inner housing to thereby divide the at least one working chamber and, a retracted position in which the gate is swung to lie adjacent the inner circumferential surface of the outer housing.

Preferably the outer housing is provided with a plurality of sockets extending longitudinally in the inner circumferential surface of the outer housing and each gate is pivotally retained and supported in a respective socket to facilitate said swinging motion of the gates.

Preferably the sockets and gates are complimentary shaped so that when the gates are in the retracted position their radially outermost surface lies substantially flush with, or set back from, the inner circumferential surface of the outer housing.

Preferably each gate comprises a root and a tail depending from the root, each root being retained in a respective socket.

Preferably each socket includes a first portion in which a respective root is retained and a contiguous second portion for receiving the tail when the gate is in the retracted position.

Preferably each socket and gate is provided with a first set of respective stop surfaces that come into mutual abutment when the gate swings to the sealing position from the retracted position to set a predetermined seal clearance between the gate and the outer circumferential surface of the inner housing.

Preferably each socket and gate is further provided with a second set respective stop surfaces spaced from the first set of stop surfaces that come into mutual abutment when the gate swings to the sealing position from the retracted position to assist in providing said predetermined seal clearance.

Preferably said first and second sets of respective stop surfaces are positioned so as to come into respective mutual contact substantially simultaneously.

Preferably the width of each lobe is greater than the width of each of said sockets.

Preferably each lobe is located immediately between an intake port and an exhaust port.

Preferably the lobes are detachable from the inner housing.

Preferably said inner housing is provided with a plurality of alternating intake ports and exhaust ports formed about its outer circumferential surface and communicating with said manifold; and, said machine further includes a plurality of lobes disposed about the outer circumferential surface of the inner housing with at least one intake port and at least one exhaust port located between adjacent lobes; and wherein said gates are arranged so that at any one time at least one gate is in the sealing position between the intake ports and exhaust ports located between adjacent lobes.

Preferably said manifold is configured to provide uniform fluid flow through the intake ports along the length of the manifold so that the fluid pressure acting on a gate is substantially the same for the length of the gate.

Preferably said machine further includes actuator means for urging said gates towards said sealing position for at least a predetermined range of angles of rotation of the outer housing relative to the inner housing.

Preferably said actuator means comprises a cam mounted coaxially with the manifold outside the rotor and respective cam followers coupled with an end of each gate that extends through the outer housing, said cam and cam followers profiled so that as said outer housing rotates relative to said inner housing the cam followers are caused to move by virtue of contact with the cam in a manner urging the corresponding gate to swing toward the sealing position for the predetermined range of angles of rotation of the outer housing relative to the inner housing.

When the machine is used as a pump, the actuator means is further configured to commence swinging the gates from the sealing position toward the retracted position prior to engagement of the gates with the lobes.

In an alternate embodiment, when the machine is used as a motor, the actuator means includes springs acting between each gate and corresponding socket for directing the gates toward the sealing position.

Preferably said lobes and exhaust ports are configured so that a gate commences to wipe across an exhaust port prior to commencing to swing toward the retracted position.

According to another aspect of the present invention there is provided a gate for a fluid rotary machine having an inner housing provided with a manifold for directing working fluid through the machine and an outer housing rotatably coupled with the inner housing to facilitate rotational motion of the outer housing relative to the inner housing with at least one working chamber being defined between the inner housing and outer housing; said gate supported on the outer housing in a manner to allow it to swing along its longitudinal axis between a sealing position in which the gate forms a seal on the outer circumferential surface of the inner housing and a retracted position in which the gate is swung to be disposed adjacent the inner circumferential surface of the outer housing, the gate provided with a first stop surface configured to abut with a first stop surface provided on the outer housing when the gate swings to the sealing position from the retractor position to set a predetermined seal clearance between the gate and the outer circumferential surface of the inner housing.

Preferably the gate is further provided with a second stop surface spaced from the first stop surface and configured to come into abutment with a second stop surface formed on the inner circumferential surface of the outer housing when the gate swings to the sealing position from the retracted position to assist in providing said predetermined seal clearance.

BRIEF DESCRIPTION OF THE DRAWINGS

Embodiments of the present invention will now be described by way of example only with reference to the accompanying drawings in which:

FIG. 8 is an end view of an inner housing incorporated in the machine;

FIG. 10 is a pictorial view of a manifold incorporated in the inner housing;

FIG. 12 is a view of section AA of the inner housing shown in FIG. 9;

FIG. 13 is a view of section BB of the inner housing shown in FIG. 9;

FIG. 14 is a view of section CC of the inner housing shown in FIG. 9;

FIG. 15 is a view of section DD of the inner housing shown in FIG. 9;

DETAILED DESCRIPTION OF THE PREFERRED EMBODIMENTS

Figure 1:
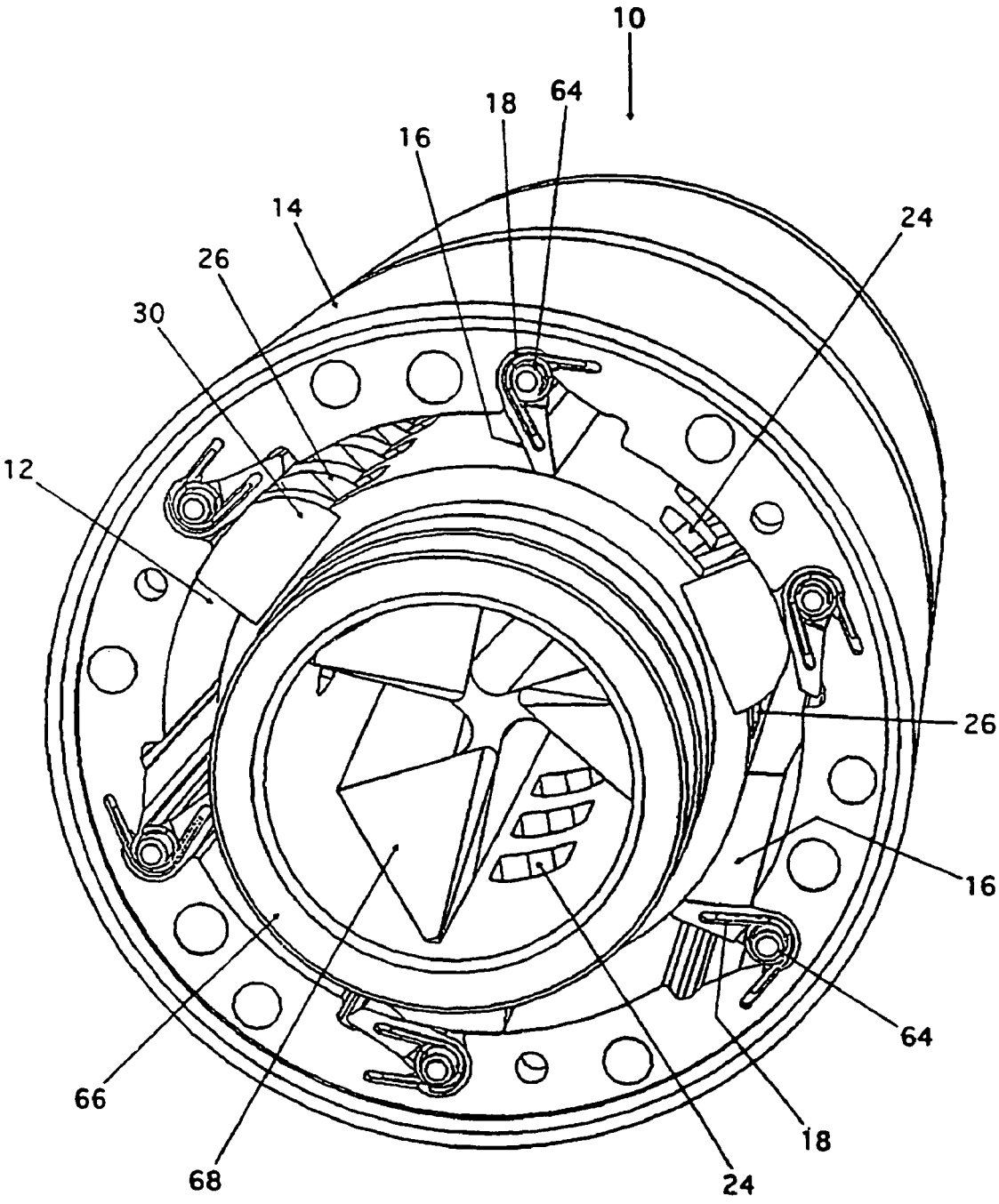
FIG. 1 is a conceptual representation of one embodiment of the fluid rotary machine in accordance with this invention.

Referring to the accompanying drawings and in particular FIGS. 1–4, it can be seen that the fluid rotary machine 10 comprises an inner housing 12 provided with a manifold 68 for directing working fluid through the machine 10; and, an outer housing 14 coupled to the inner housing 12 to facilitate rotational motion of the outer housing 14 relative to the inner housing 12. A working chamber in the form of an annular space is defined between the inner housing 12 and outer housing 14. A plurality of gates 16*a*–16*f* (referred to in general as "gates 16") are supported by the outer housing 14 and are able to swing along their respective longitudinal axes between the sealing position in which the gates form a seal on the outer circumferential surface 28 of the inner housing 12 and a retracted position in which the gates 16 are swung to lie adjacent the inner circumferential surface 32 of the outer housing 14.

Throughout this specification and claims the term "seal" when used in relation to describing the formation of a seal when a gate is in the sealing position is intended to include the formation of a substantial seal in which a small or controlled degree of leakage can occur. As described in greater detail hereinafter, the gates when in the sealing position are spaced by a controlled clearance from the outer circumferential surface of the inner housing 12. The amount of clearance provided is dependent on the nature of the fluid passing through the machine 10. Generally, the greater the viscosity of the fluid, the greater the clearance. By providing a controlled clearance, there is no surface to surface contact of the gates 16 and the outer circumferential surface of the inner housing 12.

In the embodiments illustrated herein, the outer housing 14 is formed as a rotor (ie rotates) while the inner housing 12 acts as a stator (ie is fixed). However, this can be easily reversed so that the outer housing 14 is stationary and the inner housing 12 rotates by the provision of rotary seals to allow the passage of fluid through the inner housing 12.

Figure 2:
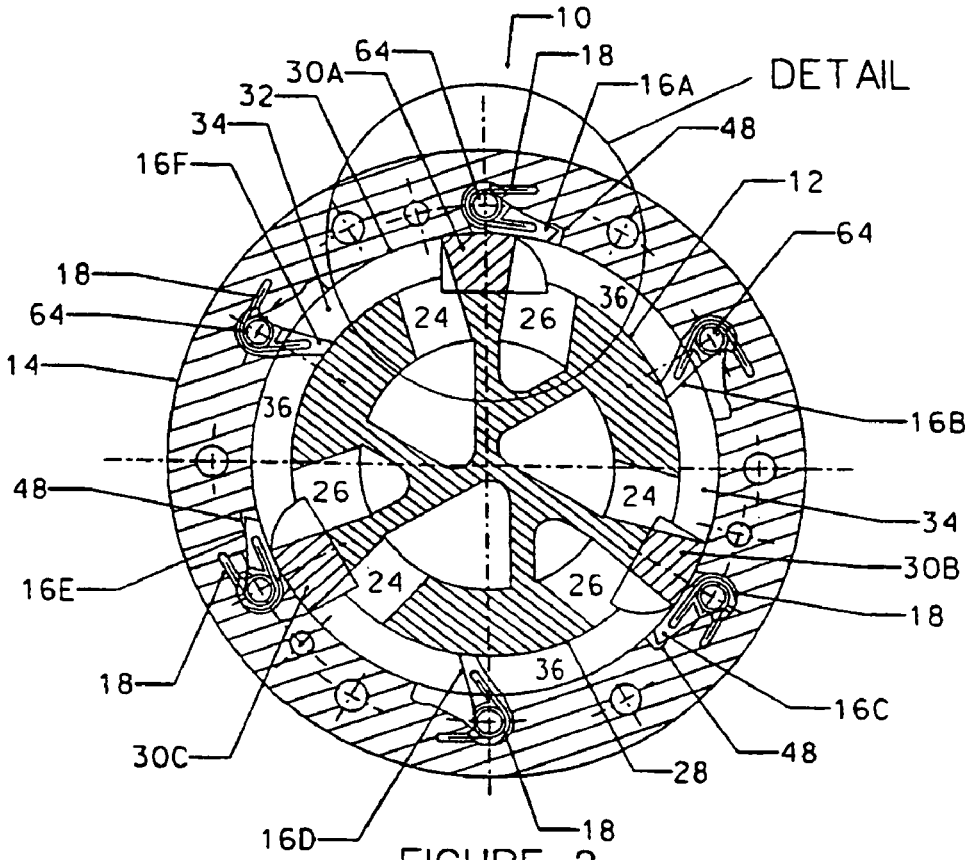
FIG. 2 is a transverse section view of the machine shown in FIG. 1.
Figure 9:
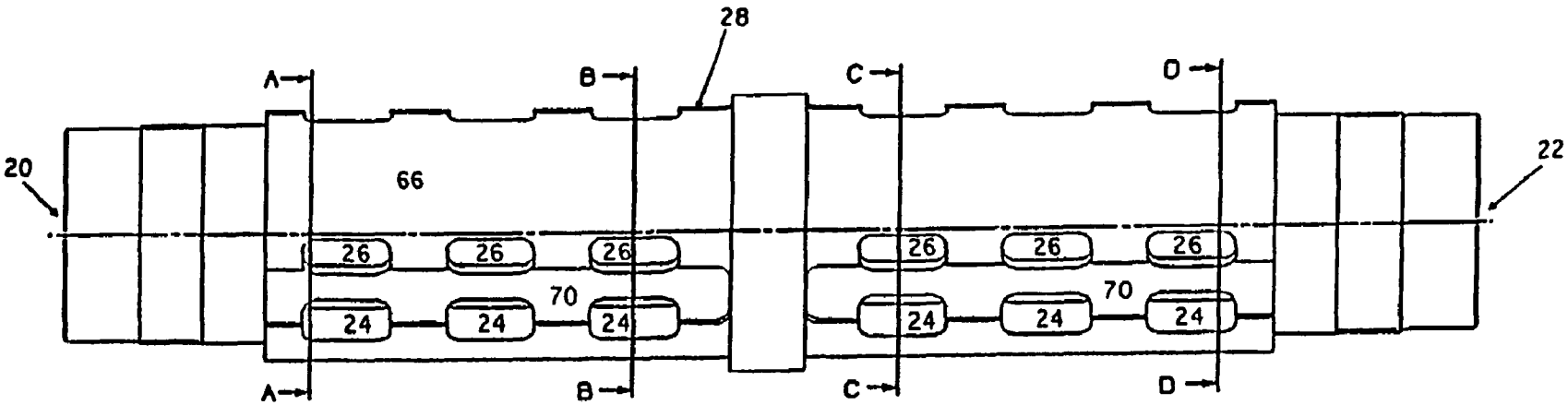
FIG. 9 is a side view of the inner housing shown in FIG. 8.
Figure 11:
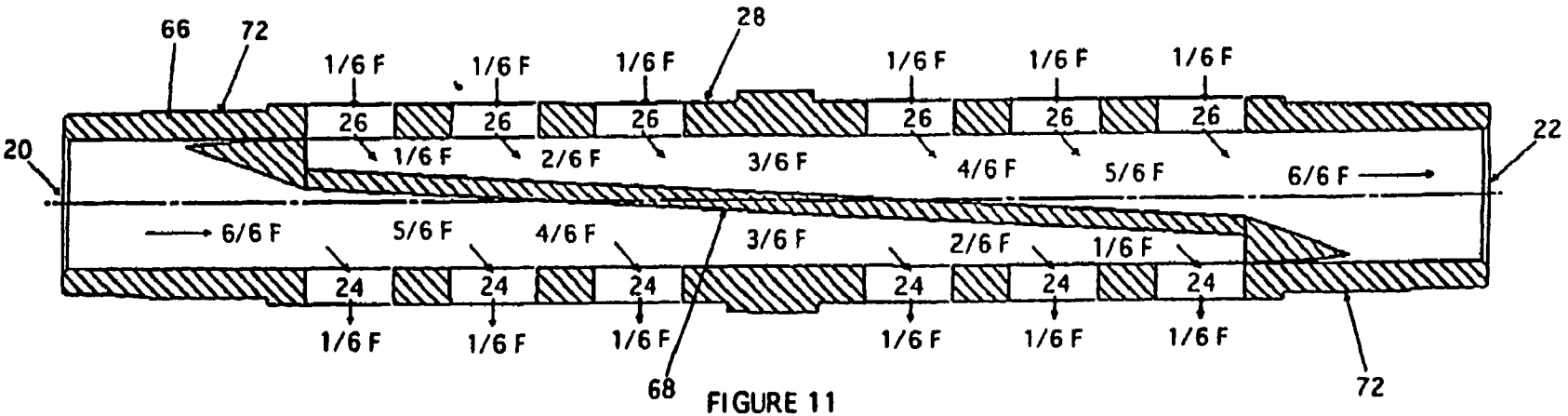
FIG. 11 is a view of section EE of the inner housing shown in FIG. 9.

Looking more closely at the machine 10 it can be seen, with particular reference to FIGS. 2, 9 and 11 that the inner housing 12 has inlet 20 at one end (the inlet end) and an outlet 22 at an opposite end (the outlet end). Further, the inner housing 12 has a plurality of alternating intake ports 24 and exhaust ports 26 formed about its outer circumferential surface 28. A plurality of elongate lobes 30*a*–30*c* (referred to in general as "lobes 30") are provided about the outer circumferential surface 28 of the inner housing 12. This arrangement is shown most clearly in FIG. 2 which depicts three lobes 30, three intake ports 24, and three exhaust ports 26. The lobes 30 are evenly spaced about the inner housing 12 as shown in FIG. 2 at the 12, 4 and 8 o'clock positions. There is one intake port 24 and one exhaust port 26 (constituting an intake and exhaust port) between adjacent lobes 30.

The six gates 16 provided in the motor 10 are evenly spaced about the inner circumferential surface 32 of the outer housing 14. The gates can swing along their respective longitudinal axis (that extend parallel to the inner housing 12) between a sealing position in which the gates form a seal on the outer circumferential surface 28 of the inner housing 12 (as shown by gates 16*b*, 16*d* and 16*f* in FIG. 2); and the retracted position in which the gates are held adjacent the inner circumferential surface 32 of the outer housing 14 (as shown by gates 16*a*, 16*c* and 16*e* in FIG. 2), to allow the passage of the lobes 30.

The gates 16 are arranged and positioned so that at any one time one gate is in the sealing position between an intake port 24 and adjacent exhaust port 26 located between pairs of adjacent lobes 30. This in turn leads to the division of the working chamber into alternating intake and exhaust chambers 34, 36. The intake chambers 34 are in communication with corresponding intake ports 24 and likewise the exhaust chambers 36 are in communication with corresponding exhaust ports 26.

In this embodiment, the machine 10 is configured as a motor. The inlet 20 of the inner housing 12 is placed in fluid communication with a supply of high pressure fluid. The inner housing 12 and associated manifold 68 distributes the fluid through the intake ports 24 in a substantially uniform manner. This fluid distribution characteristic of the manifold 68 will be described in greater detail below, suffice to say that the manifold 68 operates to ensure that substantially uniform fluid pressure acts along the entire length of the gates 16. The fluid passing through intake ports 24 then enters the corresponding intake chambers 34. A pressure differential exists between the intake chambers 34 and exhaust chambers 36 with the higher fluid pressure being in the intake chambers 34. Accordingly, the fluid acts to flow in a direction toward the low pressure and as such bears on the gates 16 forcing them, and thus the outer housing 14, to rotate in an anticlockwise direction. As the outer housing 14 rotates in the anticlockwise direction the gate 16 will eventually wipe across an exhaust port 26 through which the fluid is exhausted through the manifold to the outlet end 22.

Consider for example gate 16*f* in FIG. 2. High pressure fluid enters the intake chamber 34 between the gate 16*f* and lobe 30*a*. On the opposite side of gate 16*f* is the exhaust chamber 36 containing fluid that is in communication with, and flows through, the exhaust port 26 back through the manifold to the outlet 22. The pressure differential between the fluid in the intake chamber 34 and the exhaust chamber 36 causes the anticlockwise rotation of the outer housing 14. Eventually the gate 16*f* will commence to wipe across the exhaust port 26. Therefore the fluid in the chamber 36 will be exhausted through the port 26 and out the outlet 22 of the manifold. While all this is occurring, the preceding gate 16*a* is being swung from its retracted position shown in FIG. 2 to a sealing position to be acted upon by high pressure fluid to continue the rotation of the outer housing 14.

Figure 3:
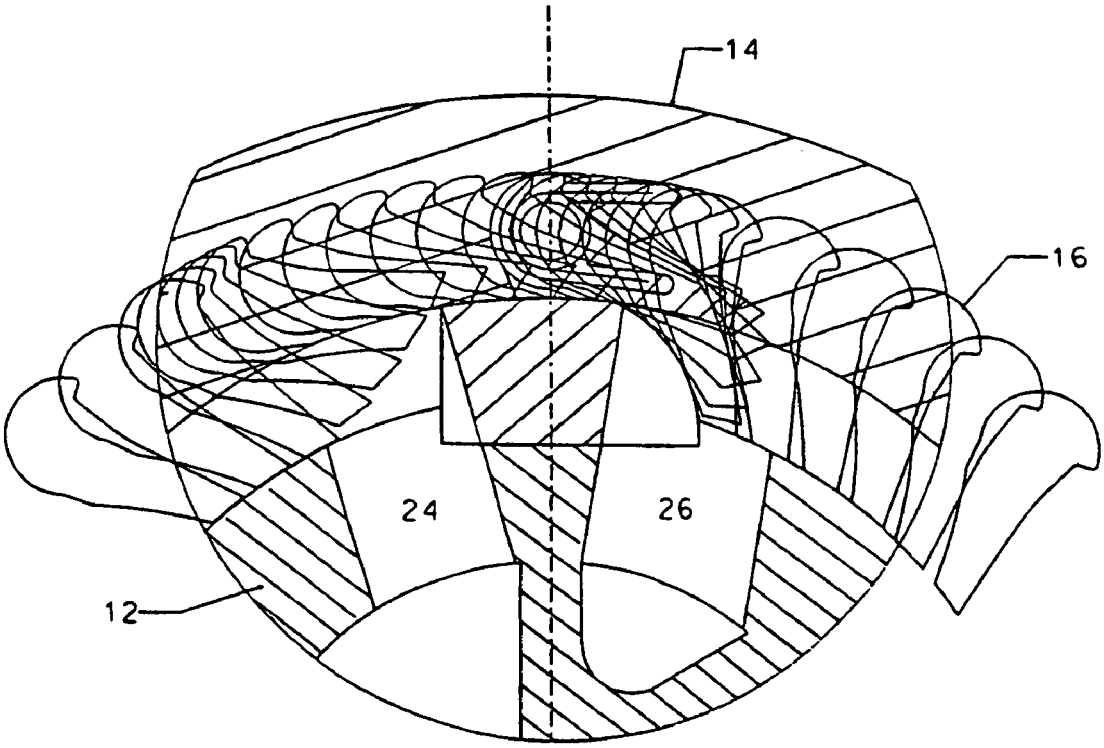
FIG. 3 is an enlarged view of a portion of the machine shown in FIG. 2.

FIG. 3 depicts the motion of a particular gate 16 in the vicinity of an exhaust port 26 and intake port 24 that are on immediate opposite sides of a lobe 30. The foot of the gate 16 has a width less than the width of the exhaust port 26. Therefore, prior to the gate 16 abutting the lobe 30, the seal created by the gate 16 is broken when the full width of the foot resides wholly over the port 26. This breaking of the seal reduces the force required to lift the gate 16 against the bias of the spring 18 and the fluid pressure to the retracted position. As the outer housing 14 continues to rotate in the anticlockwise direction, the gate 16 will eventually be in a position where it is no longer contacted by the lobe 30. At this point, the gate 16 commences to swing back toward the sealing position by virtue of the action of the spring 18. In addition, high pressure fluid entering through the intake port 24 acts on the gate 16 to assist in swinging it to the sealing position.

The various components constituting the machine 10 will now be described in further detail.

Figure 5A:
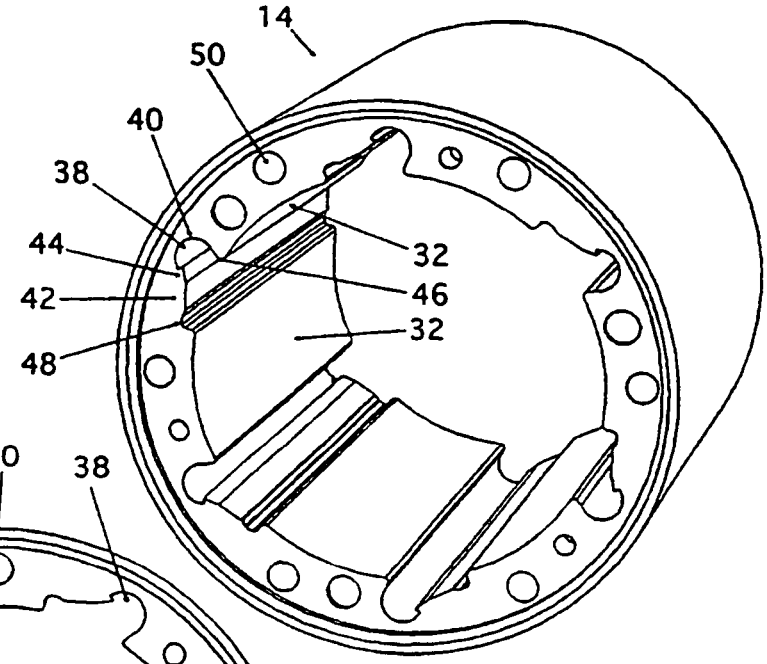
FIG. 5A is a pictorial view of an outer housing incorporated in the machine.
Figure 5B:
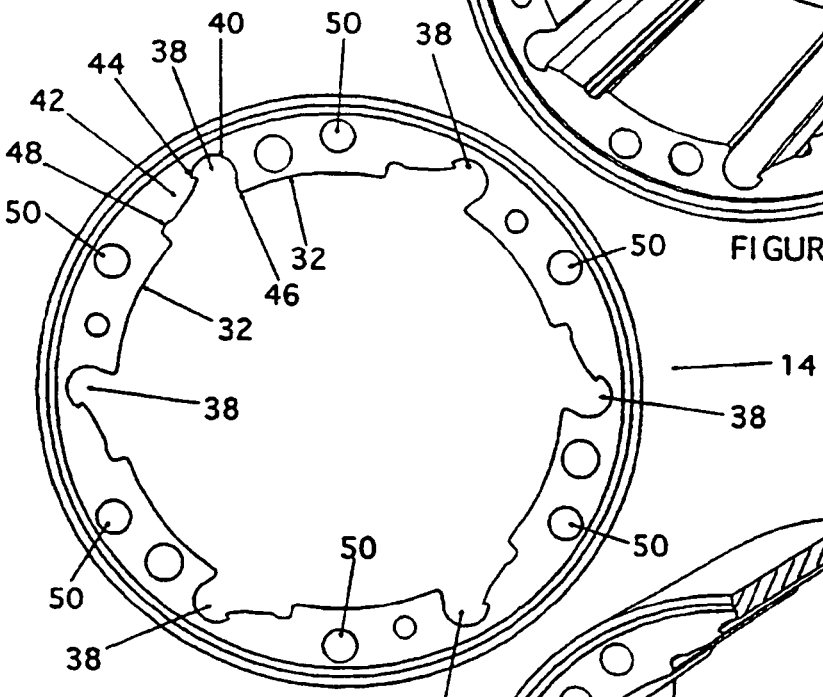
FIG. 5B is a plan view of the outer housing.
Figure 5C:
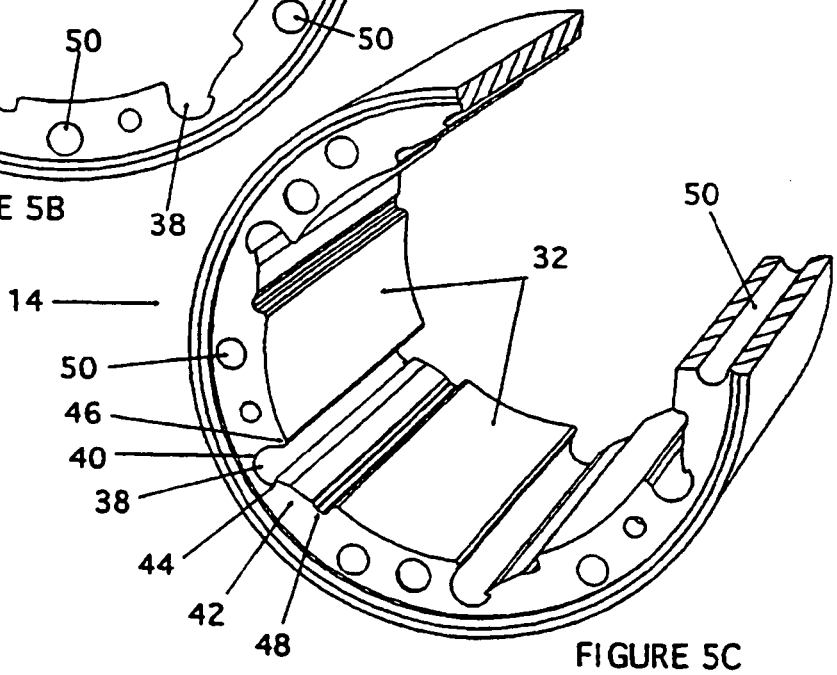
FIG. 5C is a sectional view of the outer housing.
Figure 7:
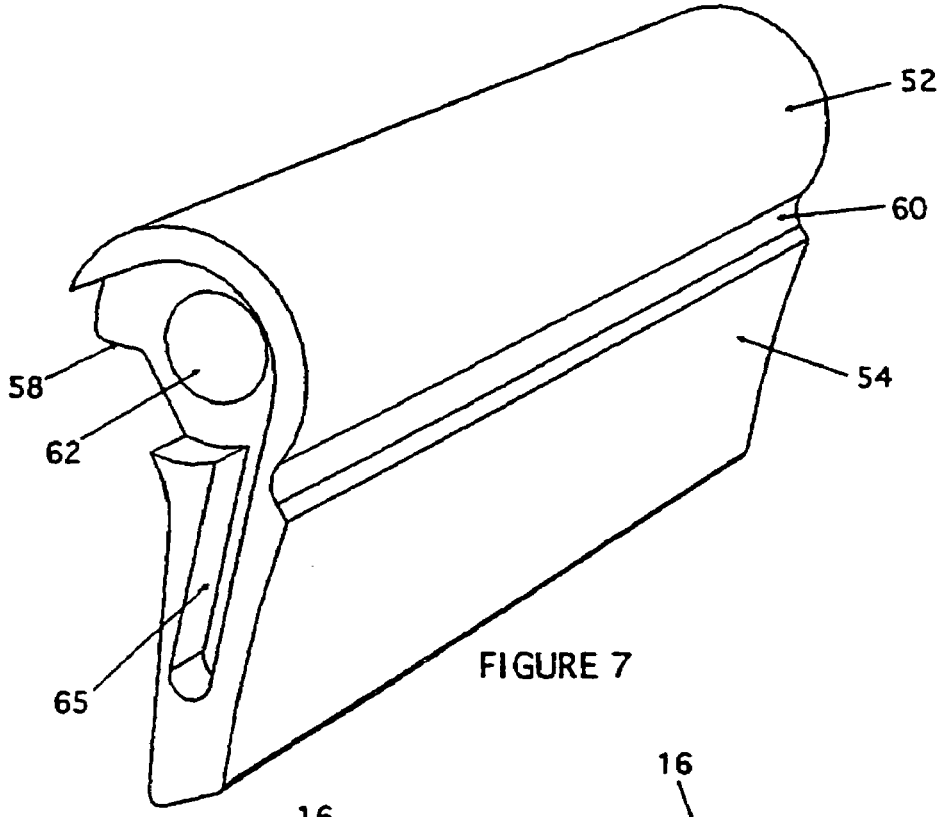
FIG. 7 is a pictorial view of the gate shown in FIGS. 6A and 6B.
Figure 6A:
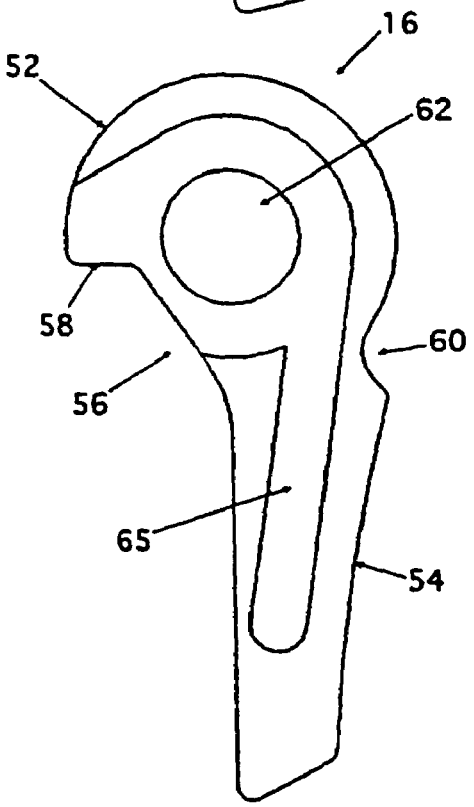
FIG. 6A is one end view of a gate incorporated in the machine.
Figure 6B:
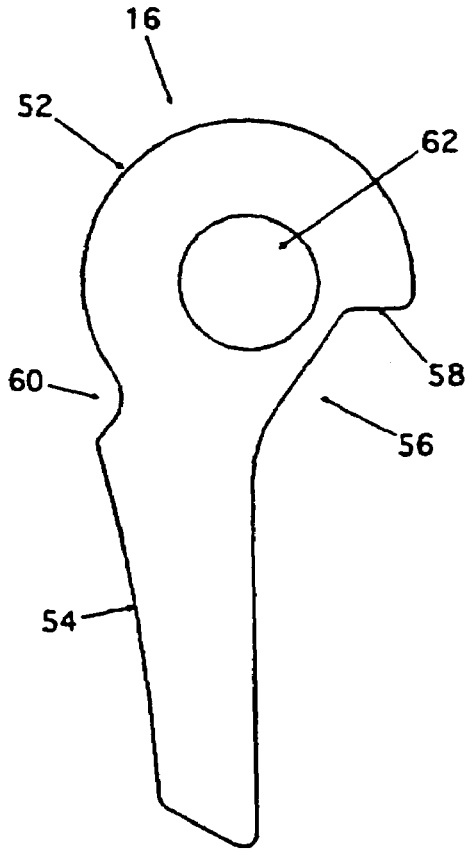
FIG. 6B is an opposite end view of the gate shown in FIG. 6A.

Referring to FIGS. 5A–5C, the outer housing 14 is in the form of a cylinder that is open at opposite ends. A plurality (in this case six) sockets 38 are formed along the inner circumferential surface 32 of the outer housing 14. The sockets 38 are evenly spaced about the inner diameter of the outer housing 14 and extend mutually parallel to the axis of the outer housing 14 (which coincides with the axis of the inner housing 12). In general terms, the sockets 38 are shaped complimentary to the shape of the gates 16 so that when the gates 16 are in a fully retracted position their radially outer most surface is flush with or set back from the inner circumferential surface 32, as shown in FIG. 2 at gates 16*a*, 16*c* and 16*e*.

Each socket 38 has a first portion 40 that has an arcuate form when viewed in plan and a contiguous second portion 42. The arcuate portion 40 is bound on opposite sides by a step 44 that leads to the second portion 42 and a ridge 46 that leads to the inner circumferential surface 32. The distal end of the second portion 42 is provided with a dog-leg shaped rebate 48 (refer FIG. 2) that extends beyond and behind the end of a gate 16 when the gate is located in a socket 38. This rebate 48 provides a path for high pressure fluid to flow behind a gate 16 immediately after the gate 16 is rotated clear of a lobe 30 so as to assist in swinging the gate 16 toward the sealing position. A plurality of bolt holes 50 are also formed in the rebate on opposite sides of the outer housing 14 to allow for assembly of the machine 10.

One possible configuration for the gates 16 is illustrated in FIGS. 1, 6A, 6B and 7. In transverse section, the gate 16 has the shape somewhat like a comma having a an upper arcuate root 52 and a depending tail 54. The root 52 is shaped so that it can be slide into the first portion 40 of a socket 38, as depicted in FIG. 1 and allow the gate 16 to swing about its longitudinal axis within the socket 38. A recess 56 is formed along the length of the gate 16 to create a step 58 between the root 52 and tail 54. On the opposite side of the gate 16 there is a arcuate recess 60 leading from the root 52 to the tail 54. The step 44 in the sockets 38 and step-58 on the gate 16 form respective first stop surfaces that come into mutual abutment when the gate 16 is swung to the sealing position. This assists in providing a predetermined clearance between the end of the gate 16 and the outer circumferential surface of the inner housing 12. As such there is no surface to surface contact between the gates 16 and outer circumferential surface of the inner housing 12, thus substantially eliminating wear in this part of the machine 10. Or course this clearance does allow for some slight leakage of fluid but the clearance is arranged so that the leakage is insignificant compared with the total volume of fluid within the chambers 34,36. Further, the ridge 46 on the socket 38 and the recess 60 on the gate 16 form a second set of respective stop surfaces that come into mutual abutment when the gate 16 swings to the sealing position from the retracted position. This also assists in maintaining the predetermined clearance. The degree of clearance for any particular application will be dependent on, among other things, the viscosity of the working fluid. Further the clearance can be varied by appropriated positioning of the steps 44, 58, ridge 46 and recess 60.

A blind hole 62 is formed axially into the root 52 at opposite ends of the gate 16. The holes 62 seat pivot pins 64 (refer FIG. 4) about which the springs 18 are located. The pins 64 also extend into various end and mating plates of the machine 10 to assist in supporting the gates 16. A groove 65 is formed at one end of the gate 16 to located and receive a spring 18.

Figure 4:
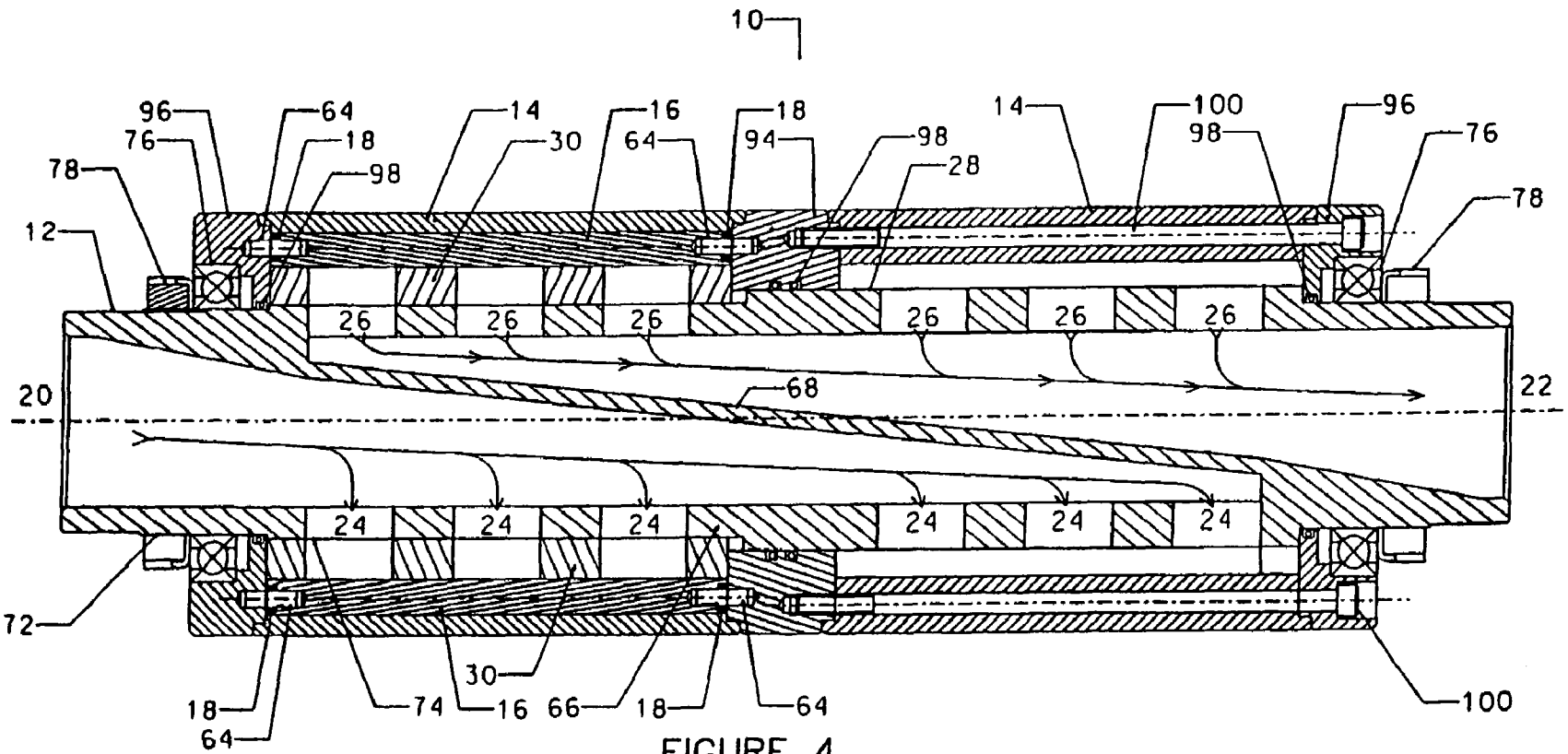
FIG. 4 is a longitudinal section view of the machine.

The inner housing 12 is depicted in FIGS. 8–15. The inner housing 12 includes an outer sleeve 66 and an internal manifold 68. The sleeve 66 is essentially in the form of a hollow pipe having a constant internal diameter and forming at one end the inlet 20 of the manifold and at the opposite end the outlet 22. The intake and exhaust ports 24, 26 are in the form of elongate holes or slots formed between the inner and outer diameters of the sleeve 66. As shown in FIGS. 9 and 11, there are alternate lines of intake ports 24 and exhaust ports 26 about the circumference of the sleeve 66. A plurality of longitudinal flats 70 are machined on the outer circumferential surface of the sleeve 66. The flats 70 are located between immediately adjacent intake and exhaust ports 24, 26. These flats seat the lobes 30. Moving axially inwardly from opposite ends of the sleeve 66 there is a stepped increased in the outside diameter of the sleeve 66 as shown at item 72 in FIGS. 4 and 11. Moving axially inwardly again, there is a further stepped increase in the outer diameter at item 74. As depicted in FIG. 4, the portions 72 of the sleeve 66 seat respective bearings 76 and lock nuts 78.

Figure 18:
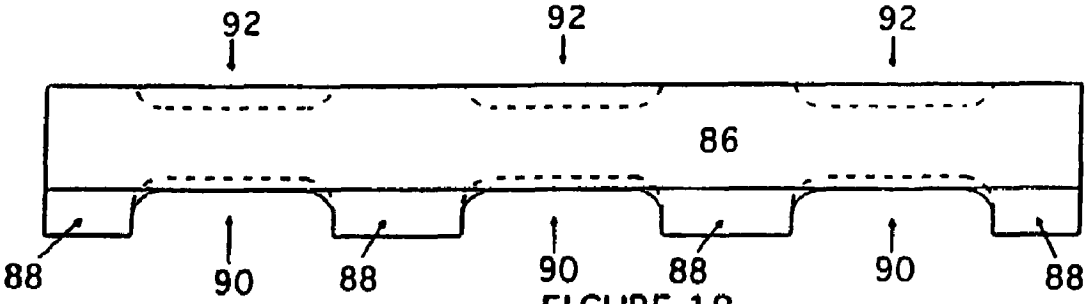
FIG. 18 is a top view of the lobe shown in FIG. 16.
Figure 17:
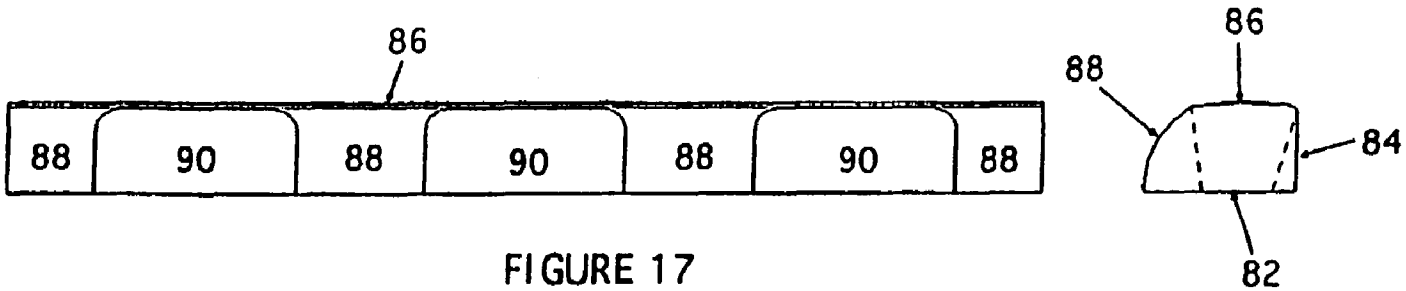
FIG. 17 is a view of one side of the lobe shown in FIG. 16.
Figure 16:
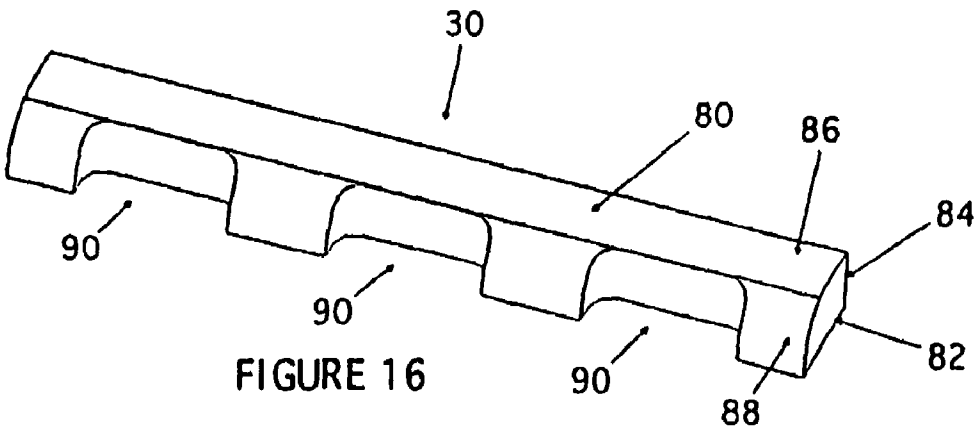
FIG. 16 is a pictorial view of a lobe incorporated in the machine.

The manifold 68 acts to divide the flow of fluid at the inlet 20 into three equal streams. Each stream feeds one of the three longitudinal lines of intake ports 24. The manifold 68 is configured so that it provides a substantially uniform flow of fluid into each and every intake port 24 irrespective of the position of that port 24 along the length of the sleeve 66. This is done by progressively and uniformly reducing the volume of the fluid available to each intake port 24 along the length of the sleeve 66. In the present example, as discussed above, the fluid presented at the inlet 20 is divided into three equal streams by the manifold 68. There are also six intake ports 24 for each stream. The manifold 68 acts so that for each stream, each port 24 is provided with one sixth of the fluid F in that particular stream. Thus, looking at FIG. 11, the left most intake port 24 is provided with one sixth of the fluid F of its respective stream with five sixth of the fluid F progressing to the next ports, of which one sixth is fed through the second intake port 24 leaving four sixth of the fluid F to progress further etc down the line until only one sixth of the original fluid F exists at the right hand end of the manifold 68, all of that flow is directed through the right most intake port 24. This flow of fluid is then return through the adjacent exhaust port 26 in substantially identical proportions so that all of the fluid in a particular flow stream at the inlet end 20 is exhausted through the outlet end 22. FIGS. 16, 17 and 18 depict a lobe 30. Each lobe 30 is in the form of an elongate bar 80 having a planar bottom surface 82 for seating on the flats 70 formed on the outer circumferential surface of the sleeve 66 of the inner housing 12 and an adjacent planar side surface 84 formed at right angles to the bottom surface 82. Upper surface 86 of the lobe is formed contiguously with the side surface 84 and extends above the bottom surface 82. The top surface 86 is formed with a radius or curvature complimentary to the radius of the inner circumferential surface 32 of the outer housing 14. An arcuate side surface 88 extends from the top surface 86 to the bottom surface 82 opposite the side surface 84. It is the side surface 88 that abuts the gates 16 to push them against the bias of spring 18 into the retracted position as the outer housing 14 rotates in the anticlockwise direction. A plurality of cut outs 90 are formed in the side surface 88. The cut outs 90 register with the exhaust ports 26 on the sleeve 66. A plurality of recesses 92 is also formed on the opposite side 84 of the lobe 30 for registration with the intake ports 24.

Returning to FIG. 4, the machine 10 illustrated is formed with two coaxially joined outer housings 14. The outer housings 14 are joined by a common annular mating plate 94. An end plate 96 is also bolted to the respective opposite ends of each rotor 14. The end plates 96 house the bearings 76. O-ring seals 98 are provided in annular grooves formed on the inner circumferential surface of the mating plate 94 and end plates 96. Bolts 100 are used to bolt the rotors 14, mating plate 94 and end plates 96 together. The pins 64 each have one end that fits within a blind hole formed in the adjacent mating plate 94 or end plate 96 as the case may be.

Figure 20:
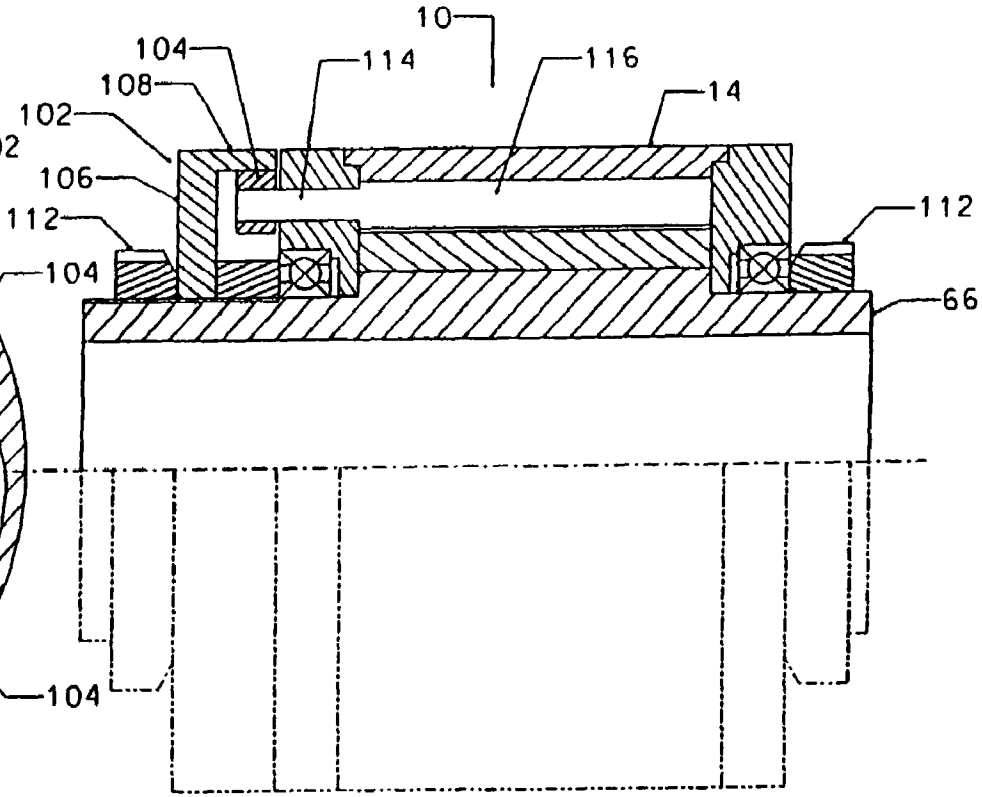
FIG. 20 is a longitudinal view of one end of the machine shown in FIG. 20.
Figure 19:
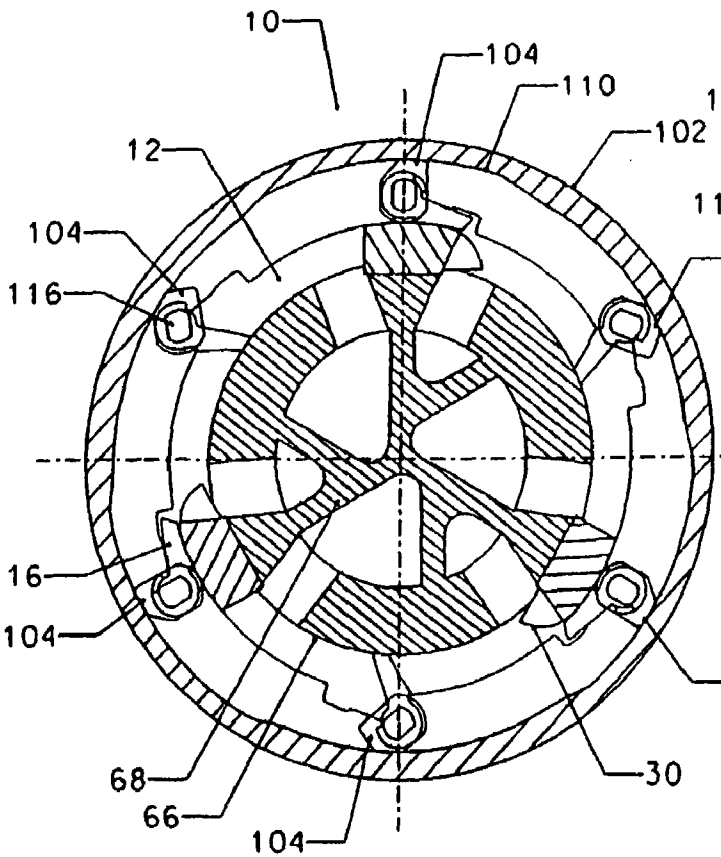
FIG. 19 is a section view of a second embodiment of the machine.
Figure 22:
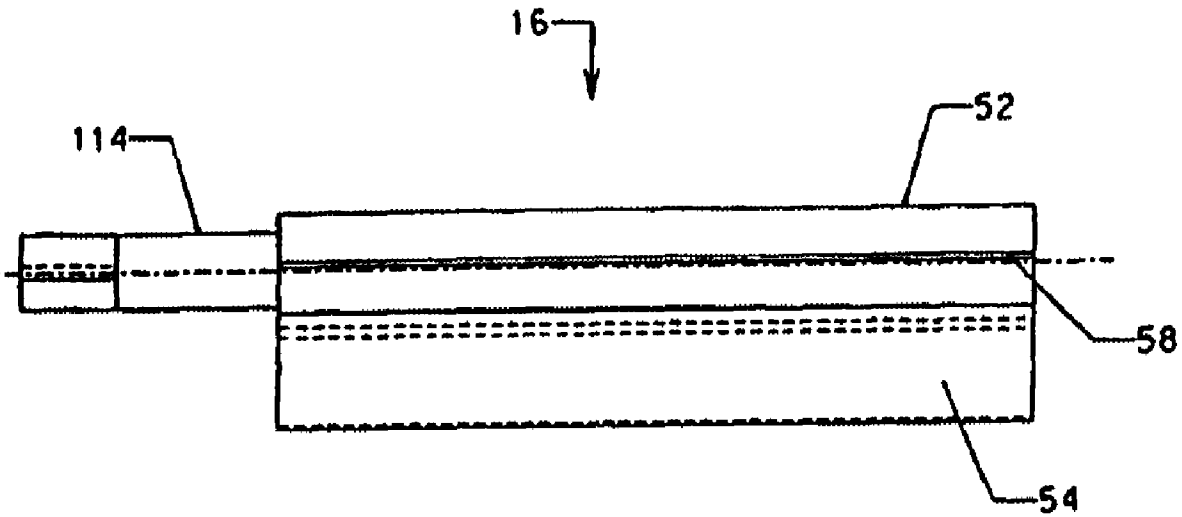
Figure 21:
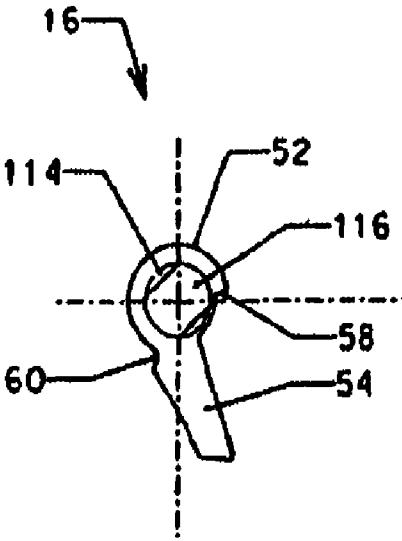
FIG. 21 is a side view of a gate incorporated in the machine shown in FIGS. 19 & 20; and, FIG. 22 is an end view of the gate shown in FIG. 21.

FIGS. 19 and 20 illustrate an alternate embodiment for the hydraulic machine 10'. In this embodiment, like reference numbers are used to denote like features. The machine 10' differs from the machine 10 essentially only in terms of the actuating means for urging the gates 16 toward the sealing position. In the first embodiment described in FIGS. 1–18 this is provided by springs 18. However in the embodiment shown in FIGS. 19 and 20, bias is provided by way of a cam 102 and a plurality of cam followers 104 coupled at the end of each gate 16. The cam 102 comprises a plate 106 and an axially extending flange 108 formed about the radially outer edge of the plate 106. Cam surface 110 is formed on the radially inner side of the flange 108. The cam 102 is locked onto the end of the shaft 66 by a lock nut 112. In order to facilitate connection of the cam follower 104 with each gate 16, an end of each gate 16 adjacent an end plate 96 is formed with a longitudinal extension 114 as shown in FIGS. 21 and 22. The extension 114 is provided at its distal end with key 116 adapted to fit within a complementarily shaped hole in a cam follower 104 to provide a non-rotating coupling between each gate 16 and its corresponding cam follower 104. That is, the key 116 and hole are shaped so that the key 116 can not rotate within the hole in the cam follower 104. The extension 114 passes through a hole formed in the end plate 96. A cam follower 104 is fixed to an end of each extension 114 protruding from the end plate 96. As the outer housing 14 rotates about the inner housing 12 the cam followers 104 contact the cam surface 110 of cam 102. The profile of the cam surface 110 and cam follower 104 are arranged so as to cause the gates 16 to swing away the retracted position as the gates 16 leaves the side surface 84 of the lobes 30.

The use of the cam 102 and cam follower 104 negates the need to use springs 18 and thus increases the reliability of the machine 10'.

The use of the cam 102 and cam follower 104 also opens the way for constructing a hydraulic machine that is fully reversible ie can act as a motor or pump. To be reversible, it is necessary that the gates 16 be able to swing in opposite directions in order to be lifted over the lobes 30 when the outer housing 14 is turning in either the clockwise or anticlockwise directions. In such an embodiment of the machine 10, 10' the sockets 38 would also need to be modified in order to accommodate the gates 16 when fully retracted in opposite directions.

In yet a further variation, by providing the extension 114 on the gates 16, other means can be used for biasing and/or controlling the movement of the gates 16 such as, for example, the use of electric motors, or hydraulic/pneumatic circuits.

Now that embodiments of the hydraulic machine 10, 10' have been described in detail, it will be apparent to those skilled in the relevant arts that numerous modifications and variations may be made without departing from the basic inventive concepts. For example, in the embodiments shown in FIGS. 1–19, the inner housing 12 is shown as having three lines of alternating intake and exhaust ports 24, 26 with six ports in each line. However, more or less ports can be arranged both circumferentially about the inner housing 12 and in each line. When there is a change in the number of lines of ports about the circumference of the inner housing 12, the manifold 68 would need to be modified in order to split the incoming flow evenly into separate flow streams for each line of intake ports 24. Further, instead of having two outer housings 14 joined end to end as depicted in FIG. 4, a single outer housing 14 of the combined length can be used. This is possible because each gate 16 is supported for essentially its whole length by the outer housing 14. This is to be distinguished from other types of fluid rotary machines, particularly hydraulic motors/pumps, where vanes are often supported only that their ends. Further, as implied by the term "fluid" the machines herein described can act on or be driven by a liquid (including a slurry) or a gas.

All such modifications and variations together with others that would be obvious to a person of ordinary skill in the art are deemed to be within the scope of the present invention the nature of which is to be determined from the above description and the appended claims.

We claim:

1. A fluid rotary machine comprising:

an inner housing comprising: a sleeve having first and second opposite axial ends, said first axial end forming an inlet for a working fluid and said second axial end forming an outlet for a working fluid such that working fluid enters and exits the machine axially, and a manifold disposed in said sleeve which directs said working fluid through said machine;

an outer housing rotatably coupled with the inner housing to facilitate rotational motion of the outer housing relative to the inner housing, with at least one working chamber through which the working fluid can flow being defined between the inner housing and outer housing; and, a plurality of gates supported on the outer housing, each gate being able to swing along its respective longitudinal axis between a sealing position in which the gate forms a seal on the outer circumferential surface of the inner housing to thereby divide the at least one working chamber and, a retracted position in which the gate is swung to lie adjacent the inner circumferential surface of the outer housing.

2. A machine according to claim 1 wherein the outer housing is provided with a plurality of sockets extending longitudinally in the inner circumferential surface of the outer housing and each gate is pivotally retained and supported in a respective socket to facilitate said swinging motion of the gates.

3. A machine according to claim 2 wherein the sockets and gates are complementary shaped so that when the gates are in the retracted position their radially outermost surface lies substantially flush with, or set back from, the inner circumferential surface of the outer housing.

4. A machine according to claim 3 wherein each gate comprises a root and a tail depending from the root, each root being retained in a respective socket.

5. A machine according to claim 4 wherein each socket includes a first portion in which a respective root is retained and a contiguous second portion for receiving the tail when the gate is in the retracted position.

6. A machine according to claim 2 wherein each socket and gate is provided with a first set of respective stop surfaces that come into mutual abutment when the gate swings to the sealing position from the retracted position to set a predetermined seal clearance between the gate and the outer circumferential surface of the inner housing.

7. A machine according to claim 6 wherein each socket and gate is further provided with a second set respective stop surfaces spaced from the first set of stop surfaces that come into mutual abutment when the gate swings to the sealing position from the retracted position to assist in providing said predetermined seal clearance.

8. A machine according to claim 7 wherein said first and second sets of respective stop surfaces are positioned so as to come into respective mutual contact substantially simultaneously.

9. A machine according to claim 2 wherein said inner housing is provided with a plurality of alternating intake ports and exhaust ports formed about its outer circumferential surface and communicating with said manifold; and, said machine further includes a plurality of lobes disposed about the outer circumferential surface of the inner housing with at least one intake port and at least one exhaust port located between adjacent lobes; and wherein said gates are arranged so that at any one time at least one gate is in the sealing position between the intake ports and exhaust ports located between adjacent lobes.

10. A machine according to claim 9 wherein the width of each lobe is greater than the width of each of said sockets.

11. A machine according to claim 10 wherein each lobe is located immediately between an intake port and an exhaust port.

12. A machine according to claim 11 wherein the lobes are detachable from the inner housing.

13. A machine according to claim 9 wherein said manifold is configured to provide uniform fluid flow through the intake ports along the length of the manifold so that the fluid pressure acting on a gate is substantially the same for the length of the gate.

14. A machine according to claim 9 further including includes a bias mechanism for urging said gates towards said sealing position for at least a predetermined range of angles of rotation of the outer housing relative to the inner housing.

15. A machine according to claim 14 wherein said bias mechanism comprises a cam mounted coaxially with the manifold outside the rotor and respective cam followers coupled with an end of each gate that extends through the outer housing, said cam and cam followers profiled so that as said outer housing rotates relative to said inner housing the cam followers are caused to move by virtue of contact with the cam in a manner urging the corresponding gate to swing toward the sealing position for the predetermined range of angles of rotation of the outer housing relative to the inner housing.

16. A machine according to claim 15 wherein the bias mechanism is further configured to commence swinging the gates from the sealing position toward the retracted position prior to engagement of the gates with the lobes.

17. A machine according to claim 14 wherein, the bias mechanism includes springs acting between each gate and corresponding socket for directing the gates toward the sealing position.

18. A machine according to claim 9 wherein said lobes and exhaust ports are configured so that a gate commences to wipe across an exhaust port prior to commencing to swing toward the retracted position.

* * * * *